US006794447B1

(12) United States Patent
Kim et al.

(10) Patent No.: US 6,794,447 B1
(45) Date of Patent: Sep. 21, 2004

(54) GOLF BALLS INCORPORATING NANOCOMPOSITE MATERIALS

(75) Inventors: Hyun Jin Kim, Carlsbad, CA (US); Cheol Jin Kim, Kyungasangnam-Do (KR)

(73) Assignee: Taylor Made Golf Co., Inc., Carlsbad, CA (US)

( * ) Notice: Subject to any disclaimer, the term of this patent is extended or adjusted under 35 U.S.C. 154(b) by 0 days.

(21) Appl. No.: 09/627,591

(22) Filed: Jul. 28, 2000

(51) Int. Cl.[7] ..... A63B 37/02; A63B 37/12; C08K 3/34

(52) U.S. Cl. ..... 524/789; 524/445; 524/790; 473/357; 473/365; 473/371; 473/374; 473/377; 473/378

(58) Field of Search ..... 524/445, 789, 524/790; 473/357, 365, 371, 374, 377, 378

(56) References Cited

U.S. PATENT DOCUMENTS

| | | | | | |
|---|---|---|---|---|---|
| 4,894,411 | A | * | 1/1990 | Okada | |
| 5,385,776 | A | | 1/1995 | Maxfield et al. | 428/297 |
| 5,779,561 | A | | 7/1998 | Sullivan et al. | 473/373 |
| 5,810,677 | A | | 9/1998 | Maruko et al. | 473/357 |
| 5,833,553 | A | | 11/1998 | Sullivan et al. | 473/374 |
| 5,962,553 | A | | 10/1999 | Ellsworth | 523/216 |
| 6,012,991 | A | | 1/2000 | Kim et al. | 473/374 |
| 6,060,549 | A | * | 5/2000 | Li | |
| 6,117,025 | A | * | 9/2000 | Sullivan | |
| 6,203,451 | B1 | | 3/2001 | Rajagopalan | 473/371 |
| 2003/0130061 | A1 | | 7/2003 | Rajagopalan et al. | 473/354 |

OTHER PUBLICATIONS

Encyclopedia of Chemical Technology, vol. 6, p. 416–418, 1993.*

Encyclopedia of Polymer Science and Engineering, vol. 7, p. 54–55, 1988.*

Destefani, James D, "Small But Mighty," *Molding Systems*, Oct. 1999, pp. 32,34–36.

Technical Data, General Information About Nanomers, Nanocor, 2 pages.

* cited by examiner

*Primary Examiner*—David J. Buttner
(74) *Attorney, Agent, or Firm*—Sheppard Mullin Richter & Hampton LLP

(57) ABSTRACT

A golf ball incorporates nanocomposite material, nanofiller material, or both, in its core, cover, or intermediate layers. Also, a method includes a step of blending into a composition for a golf ball nanocomposite material, nanofiller material or both. The nanocomposite and/or nanofiller materials impart favorable properties to materials used for golf balls, and they provide for greater versatility in usage than materials previously used. Particular compositions incorporating nanocomposite material also are described as suited for use in golf ball compositions.

12 Claims, No Drawings

GOLF BALLS INCORPORATING NANOCOMPOSITE MATERIALS

BACKGROUND OF THE INVENTION

This invention relates generally to golf ball compositions and methods for making golf balls having these compositions. The compositions are formulated to optimize the golf balls' performance properties.

Golf balls generally comprise a core and at least one cover layer surrounding the core. Balls can be classified as two-piece, multi-layer, or wound balls. Two-piece balls include a spherical inner core and an outer cover layer. Multi-layer balls include a core, a cover layer, and one or more intermediate layers. Wound balls include a core, a rubber thread wound under tension around the core to a desired diameter, and a cover layer, typically of balata material. Generally, two-piece balls have good ball distance when hit and durability, but poor "feel" the overall sensation transmitted to the golfer while hitting the ball-and low spin rate, which results in poor ball control. Wound balls having balata covers generally have high spin rate, leading to good control, and good feel, but they have short distance and poor durability in comparison to two-piece balls. Multi-layer balls generally have performance characteristics between those of two-piece and wound balls; that is, multi-layer balls exhibit distance and durability inferior to two-piece balls but superior to wound balata balls, and they exhibit feel and spin rate inferior to wound balata balls but superior to two-piece balls.

Material characteristics of the compositions used in the core, cover, and any intermediate layers are among the important factors that determine the performance of the resulting golf balls. In particular, the composition of the core is important in determining the core's coefficient of restitution (C.O.R) and compression ratio, which are important factors in determining the ball's speed. Further, the composition of intermediate layers in multi-layer balls is important in determining the ball's spin rate and controllability. Finally, the composition of the cover layer is important in determining the ball's durability, scuff resistance, speed, shear resistance, spin rate, "click" (the sound made by a golf club head when it hits the ball), and feel.

Various materials having different physical properties are used to make core, cover and intermediate layers to create a ball having the most desirable performance possible. For example, many modern cover and intermediate golf ball layers are made using soft or hard ionomeric resins, elastomeric resins, or blends of these. Ionomeric resins used generally are ionic copolymers of an olefin and a metal salt of a unsaturated carboxylic acid, or ionomeric terpolymers having a co-monomer within its structure. These resins vary in resiliency, flexural modulus, and hardness. Examples of these resins include those marketed under the name SURLYN manufactured by E.I. DuPont de Nemours & Company of Wilmington, Del., and IOTEK manufactured by Exxon Mobil Corporation of Irving, Tex. Elastomeric resins used in golf balls include a variety of thermoplastic or thermoset elastomers available. Ball cores generally are made from polybutadiene rubbers.

Each of the materials discussed above has particular characteristics that can lead to good golf ball properties. However, one material generally cannot optimize all of the important properties of a golf ball. Properties such as feel, spin rate, resilience, and durability all are of importance, but improvement of one of these properties by use of a particular material often can lead to worsening of another. For example, ideally, a golf ball cover should have low hardness, high spin rate, and good feel, without sacrificing ball speed, distance, or durability. Such a cover would be difficult to make using only an ionomer resin having a high flexural modulus, because the resulting cover, while having good distance and durability, also will have poor feel and low spin rate, leading to reduced controllability of the ball.

To try to improve golf ball properties, some of the materials discussed above can be blended to produce golf ball cores, intermediate layers, or cover layers. As discussed above, ideally a golf ball cover should provide high spin rate and good feel, without sacrificing the ball's distance and durability. Therefore, an ionomer having a high flexural modulus often is combined in a cover composition with an ionomer or elastomer having a low flexural modulus. The resulting intermediate-modulus blend will have acceptable hardness, spin, and durability. In addition to the above materials, golf ball compositions also can include various fillers, fibers, colorants, and processing aids to impart additional desirable mechanical or cosmetic properties to the golf ball. An example of use of fibers in an intermediate layer of a golf ball is described in U.S. Pat. No. 6,012,991 to Kim et al. The fiber material described in that patent is added to intermediate layer compositions to enhance their hardness.

However, even with blending of materials to improve properties, use of the materials discussed above is not completely satisfactory. Improving one characteristic can lead to worsening another. For example, blending an ionomer having a high flexural modulus with an ionomer having a low flexural modulus can lead to reduced resilience and durability compared to use of the high-modulus ionomer alone. In general it is difficult to make a material for an intermediate or cover layer for a golf ball that has low hardness, good feel, high speed, high resilience, and good shear durability. Similar difficulties exist in optimizing ball core properties.

In view of the above, it is apparent that materials are needed for use in making golf balls that allow the optimization of many ball performance properties without the worsening of other properties. The material also preferably should provide little or no added processing difficulties. The present invention fulfills this need and other needs, and provides further related advantages.

SUMMARY OF THE INVENTION

The present invention is embodied in golf balls incorporating nanocomposite and/or nanofiller material in their cores, outer cover layers, or, if present, intermediate layers. The nanocomposite material includes a polymer, such as polyamide, ionomer, polycarbonate, polyurethane, polystyrene, polyethylene, fluoropolymer, polyamide elastomer, thermoplastic polyolefin, polyester elastomer, polyester, polyolefin, thermoplastic elastomer, thermoplastic vulcanizate, and epoxy resin, or mixtures of these. Substantially evenly dispersed within and reacted into the structure of this polymer are particles of inorganic material. The largest dimension of these particles is one micron or smaller, and this largest dimension is at least an order of magnitude greater than the smallest dimension of the particles. The particles preferably consist essentially of clay, such as hydrotalcite, montmorillonite, micafluoride, or octosilicate. The nanofiller material consists of these inorganic particles themselves, without incorporation into polymer.

In one aspect of the invention, nanocomposite material is present in an amount ranging from about 1% to 50% by weight of the cores, covers, or intermediate layers of the golf balls embodying the present invention, more preferably from about 1% to 40% by weight, and most preferably from about 5% to 30% by weight. In another aspect of the invention, nanofiller material is present in an amount ranging from about 0.1% to 20% by weight of the cores, covers, or intermediate layers of the golf balls embodying the present invention, more preferably from about 0.1% to 15% by weight, and most preferably from about 0.1% to 10% by weight.

The present invention also is embodied in a golf ball having a cover layer incorporating 10% to 20% of a nanocomposite material that includes a polyamide and inorganic phillosilicate particles of dimension as described above. In one embodiment of the invention, the golf ball cover can include an amide block copolymer, particularly a polyether amide block copolymer. In another embodiment of the invention, the golf ball cover can include a block copolymer comprising a first polymer block comprising an aromatic vinyl compound, a second polymer block comprising a conjugated diene compound, and a hydroxyl group located at a terminal block copolymer.

The present invention also is embodied in a golf ball incorporating both nanocomposite and nanofiller materials and also in methods for making a composition for use in golf balls that include nanocomposite or nanofiller materials.

Other features and advantages of the present invention should become apparent from the following detailed description of the preferred embodiments.

DESCRIPTION OF THE PREFERRED EMBODIMENTS

The present invention is embodied in a golf ball incorporating nanocomposite and/or nanofiller materials and a method of manufacture of such a ball. Nanofiller materials are nanometer-scale inorganic reinforcing particles, generally made of clay, having a high relative surface area because of their plate-like structure. Nanocomposite materials are materials incorporating from about 1% to 10% of nanofiller material reacted into and substantially evenly dispersed into the structure of an organic material, such as a polymer, to provide strength, temperature resistance, and other property improvements to the resulting composite. Descriptions of particular nanocomposite materials and their manufacture can be found in U.S. Pat. Nos. 5,962,553 to Ellsworth, 5,385,776 to Maxfield et al., and 4,894,411 to Okada et al. Examples of nanocomposite materials currently marketed include M1030D, manufactured by Unitika Limited, of Osaka, Japan, and 1015C2, manufactured by UBE America of New York, N.Y. The present invention is embodied in the use of nanofiller and/or nanocomposite materials blended into materials conventionally used in making golf balls.

The organic materials used in the present invention, either as the organic component of the nanocomposite material, or as the material to which nanofiller material is added, can be thermoset or thermoplastic resins. Examples of suitable thermoset resins include polybutadiene, polyisoprene, silicone rubber, polyurethane, and epoxy. Examples of suitable thermoplastic resins include ionomeric and non-ionomeric resins. Examples of suitable ionomeric resins include copolymer-type ionomers having varied acid contents and degrees of acid neutralization, neutralized by monovalent or bivalent cations, and also terpolymeric ionomers having a comonomer in the structure having varied acid contents and degrees of acid neutralization, neutralized by monovalent or bivalent cations. Examples of these include α-olefin/unsaturated carboxylic acid copolymer-type ionomeric resin and terpolymeric resin having a softening comonomer, such as acrylate or methacrylate. The acid moiety is neutralized to form an ionomer by a cation such as lithium, sodium, potassium, magnesium, calcium, barium, lead, tin, zinc, aluminum, or a combination of these. Examples of these resins include those sold under the trade names SURLYN and IOTEK, discussed above.

Additional examples of suitable thermoplastic resins include polyamide, copolyamide, polyester, copolyester, polycarbonate, polyolefin, polyphenyleneoxide, polyphenylenesulfide, polyimide, polystyrene, polyvinylchloride, polyurethane, thermoplastic elastomer, thermoplastic vulconizates and fluoropolymer. Examples of suitable elastomers include polyester thermoplastic urethane, polyether thermoplastic urethane, copolyetherester elastomer, copolyesterester elastomer, polyamide elastomer, olefmic elastomer, ethylene-vinyl acetate copolymers, ethylene-octene copolymer, rubber-based copolymer, cyclic olefin copolymer, and olefliic thermoplastic elastomer. Examples of olefinic thermoplastic elastomers include blends of polyolefins having ethyl-propylene-nonconjugated diene terpolymer, rubber-based copolymer, and dynamically vulcanized rubber-based copolymer. Examples of these include products sold under the trade names SANTOPRENE, DYTRON, VISAFLEX and VYRAM by Advanced Elastomeric Systems of Akron, Ohio, and SARLINK by DSM of Haarlen, the Netherlands.

Examples of rubber-based copolymers include multiblock rubber-based copolymers, particularly those in which the rubber block component is based on butadiene, isoprene, or ethylene/butylene. The non-rubber repeating units of the copolymer may be derived from any suitable monomers, including meth(acrylate) esters, such as methyl methacrylate and cyclohexylmethacrylate, and vinyl arylenes, such as styrene. Examples of styrenic copolymers are resins manufactured by Shell chemicals under the trade names KRATON D (for styrene-butadiene-styrene and styrene-isoprene-styrene types) and KRATON G (for styrene-ethylene-butylene-styrene and styrene-ethylene-propylene-styrene types). Examples of randomly distributed styrenic polymers include paramethylstyrene-isobutylene (isobutene) copolymers developed by Exxon Mobil Corporation.

Examples of copolyester elastomers include polyether ester block copolymers, polylactone ester block copolymers, and aliphatic and aromatic dicarboxylic acid copolymerized polyesters. Polyether ester block copolymers are copolymers comprising polyester hard segments polymerized from a dicarboxylic acid and a low molecular weight diol and polyether soft segments polymerized from an alkylene glycol having 2 to 10 atoms. Polylactone ester block copolymers are copolymers having polylactone chains instead of polyether as the soft segments discussed above for polyether ester block copolymers. Aliphatic and aromatic dicarboxylic copolymerized polyesters are copolymers of an acid component selected from aromatic dicarboxylic acids, such as terephthalic acid and isophthalic acid, and aliphatic acids having 2 to 10 carbon atoms with at least one diol component, selected from aliphatic and alicyclic diols having 2 to 10 carbon atoms. Blends of an aromatic polyester and an aliphatic polyester also may be used for these. Examples of these include products marketed under the trade names HYTREL by E.I. DuPont de Nemours & Company, and SKYPEL by S.K. Chemicals of Seoul, South Korea.

Examples of thermoplastic elastomers suitable for use in the present invention include those having functional groups, such as carboxylic acid, maleic anhydride, glycidyl, norbonene, and hydroxyl. An example of these includes a block polymer having at least one polymer block A comprising an aromatic vinyl compound and at least one polymer block B comprising a conjugated diene compound, and having a hydroxyl group at the terminal block copolymer, or its hydrogenated product. An example of this polymer is sold under the trade name HG-252 by Kuraray Company of Kurashiki, Japan. Other examples of these include: maleic anhydride functionalized triblock copolymer consisting of polystyrene end blocks and poly(ethylene/butylene), sold under the trade name KRATON FG 1901X by Shell Chemical Company; maleic anhydride modified ethylene-vinyl acetate copolymer, sold under the trade name FUSABOND by E.I. DuPont de Nemours & Company; ethylene-isobutyl acrylate-methacrylic acid terpolymer, sold under the trade name NUCREL by E.I. DuPont de Nemours & Company; ethylene-ethyl acrylate-methacrylic anhydride terpolymer, sold under the trade name BONDINE AX 8390 and 8060 by Sumitomo Chemical Industries; bromonated styrene-isobutylene copolymers sold under the trade name BROMO XP-50 by Exxon Mobil Corporation; and resins having glycidyl or maleic anhydride functional groups sold under the trade name LOTADER by Elf Atochem of Puteaux, France.

Examples of polyamide elastomers include polyether amide elastomers, such as polyether amide block copolymer. Examples of these are sold under the trade name PEBAX by Elf Atochem. Mixtures of all of the above-mentioned resins also can be used in the present invention, as can many other known types of polymer.

Inorganic nanofiller material generally is made of clay, such as hydrotalcite, montmorillonite, micafluoride, or octosilicate. To facilitate incorporation of the nanofiller material into polymer material, either in preparing nanocomposite materials or in preparing polymer-based golf ball compositions, the clay particles generally are coated by a suitable compatibilizing agent. The compatibilizing agent allows for superior linkage between the inorganic and organic material, and it also can account for the hydrophilic nature of the inorganic nanofiller material and the possibly hydrophobic nature of the polymer. Many compatibilizers are available, and a specific one is selected based on the particular polymer or polymers with which the nanofiller material is being combined. The nanofiller materials can be incorporated into the polymer either by dispersion into the particular monomer prior to polymerization, or by melt compounding of the particles into the polymer.

As mentioned above, the nanofiller particles have a plate structure, with individual platelets being roughly 1 nanometer (nm) thick and 100 to 1000 nm across. These particles have extremely high surface area, resulting in high reinforcement efficiency to the material at low loading levels of the particles. The sub-micron-sized particles enhance the stiffness of the material, without increasing its weight or opacity and without reducing the material's low-temperature toughness. Materials incorporating nanofiller materials can provide these property improvements at much lower densities than those incorporating conventional fillers. For example, a nylons nanocomposite material manufactured by RTP Corporation of Wichita, Kans. uses a 3% to 5% clay loading and has a tensile strength of 11,800 psi and a specific gravity of 1.14, while a conventional 30% mineral-filled material has a tensile strength of 8,000 psi and a specific gravity of 1.36. Because use of nanocomposite materials with lower loadings of inorganic materials than conventional fillers provides the same properties, this use allows products to be lighter than those with conventional fillers, while maintaining those same properties.

Nanocomposite and nanofiller materials can be used in ball covers, cores and intermediate layers for making two-piece or multilayer balls. The materials also can be used in cores or cover layers for making wound balls. If a suitable nanocomposite material is used in, for example, a golf ball cover composition made of a soft and resilient material, it is possible to modify the modulus of the cover composition without sacrificing its resilience. To achieve the same modulus modification by adding a higher-modulus polymer resin into the same base resin, it is necessary to add a much higher loading level of the high-modulus resin. This can result in losing the benefit of the resilience of the original base resin. If a conventional filler material is used, the high filler loading levels required to adjust flexural modulus also can adversely affect the cosmetic properties of the resulting materials. This cosmetic effect can be avoided or reduced by use of nanocomposite or nanofiller materials.

Similarly, when used in core compositions, nanocomposite materials allow adjustment of the compression ratio and C.O.R. of the resulting core without substantially increasing its hardness. Usually, these properties are adjusted using a curing agent or a co-agent, which also can lead to increased hardness. Use of nanocomposite materials, therefore, allows for increased flexibility in adjusting these properties.

Nanocomposite and nanofiller materials also can have processing advantages over use of conventional filler materials, such as greater case of melt processing and reduced mold wear. For example, addition of nanocomposite or nanofiller materials can raise the heat deflection temperature of the resulting compositions. This allows for a wider window of processing temperatures, which provides for flexibility in painting or other finishing processes for the resulting golf ball. Nanocomposite and nanofiller materials also improve the barrier properties of the resulting compositions. This is important in golf ball compositions, for example, in preventing moisture from entering a ball, because moisture may reduce the C.O.R. of ball cores and has generally adverse properties on polymers used in ball compositions.

When used in the manufacture of golf balls, nanocomposite materials can be blended effectively into ball compositions to be from about 1% to 50% of the total composition by weight, with a preferred range from about 1% to 40%, and an optimal range of from about 5% to 30% of the total composition by weight. Nanofiller materials can be blended effectively into ball compositions to be from about 0.1% to 20% of the total composition by weight, with a preferred range from about 0.1% to 15%, and an optimal range of from about 0.1% to 10% of the total composition by weight. The nanocomposite and nanofiller materials can also be used in combination. In this case, the materials can be blended effectively into golf ball compositions when the total loading of the nanofiller materials, i.e., the nanofiller material separately added and the nanofiller material incorporated into the nanocomposite material, is within the ranges described above for use of nanofiller material alone. Use of a greater percentage of the nanocomposite or nanofiller materials can make the composition too rigid or brittle, while use of a lesser percentage can make the effect of the nanocomposite or nanofiller material on the physical properties of the composition less apparent. The remainder of the ball composition can be comprised of any of the polymer materials commonly used in golf ball compositions, such as ionomeric and elastomeric resins and block copolymers. Any colorants, stabilizers, antioxidants, processing aids, fillers, or mold release agents commonly used in the manufacture of golf balls also can be blended with nanocomposite or nanofiller materials. During the manufacturing process, the nanocomposite or nanofiller materials can be blended into the other components of the golf ball composition using known techniques, such as compounding and extrusion.

EXAMPLE

Use of nanocomposite materials was tested in golf ball covers. Test golf balls were prepared in which the covers comprised either 10% or 20% by weight of nanocomposite material. The particular nanocomposite material used was M1030D, a polyamide 6-based nanocomposite material manufactured by Unitika, Limited. of Tokyo, Japan. This nanocomposite material is prepared by dispersion of treated nanometer-scale phillisilicate in the base monomer prior to polymerization. This nanocomposite material has low specific gravity, high modulus and high strength, and therefore it is particularly suitable for use in golf ball cover compositions. Other comparable nanocomposite materials, such as those discussed above, also could be used, depending upon the particular properties to be imparted to the resulting golf ball.

The test balls each had a core having a PGA compression of 70. Over each core was placed a mantle layer having a hardness of 37 on the Shore D scale, a flexural modulus of 9.7 kpsi, and a tensile elongation of 717%. Over each mantle layer was placed a cover layer comprising nanocomposite material and either: PEBAX 3533, a polyether amide block copolymer marketed by Elf Atochem; or HG-252, a block copolymer having at least one polymer block comprising an aromatic vinyl compound and at least one polymer block comprising a conjugated diene compound, and having a hydroxyl group at the terminal block copolymer, or its hydrogenation product, marketed by Kuraray Company. Use of a polymer in the nanocomposite material that is in the same polymeric family as the polymer in the remainder of the composition is expected to provide good compatibility between the components. The cover compositions incorporating the nanocomposite material were manufactured using conventional compounding techniques. The particular cover composition percentages of the two ball types are provided below in Table 1.

TABLE 1

Test Ball Cover Compositions

| Ball | M1030D wt % | PEBAX 3533 wt % | HG-252 wt % |
|---|---|---|---|
| Test #1 | 10 | 90 | 0 |
| Test #2 | 20 | 80 | 0 |
| Test #3 | 10 | 0 | 90 |
| Test #4 | 20 | 0 | 80 |

Testing

The balls were tested for spin rate and speed when hit with an 8-iron and with a driver and for surface hardness on the Shore D scale. The balls also were tested for shear resistance using a robot to simulate real-life impact conditions at 80 mph club head speed. Three of each type of ball were used for this testing. Each ball was assigned a numerical score from 1 (no visible damage) to 5 (substantial material displaced), and these scores were averaged for each ball type to produce the shear resistance numbers below.

In addition to the balls incorporating nanocomposite material, several golf balls currently available on the market were tested for the same parameters. These balls included the Professional, Tour Balata, and HP Tour, manufactured by Titleist Corporation of Fairhaven, Mass. and also the InerGel Pro and InerGel Pro Distance, manufactured by Taylor Made Golf Company of Carlsbad, Calif. Results of the tests are show below in Table 2.

TABLE 2

Performance of Balls

| Ball Type | Cover Hardness (Shore D) | 8 Iron Spin (rpm) | 8 Iron Speed (mph) | Driver Spin (rpm) | Driver Speed (mph) | Shear Resistance |
|---|---|---|---|---|---|---|
| Test #1 | 29 | 9683 | 110.2 | 3792 | 158.5 | 3.8 |
| Test #2 | 35 | 9259 | 110.2 | 3664 | 158.4 | 3.6 |
| Test #3 | 30 | 9652 | 110.0 | 3803 | 159.2 | 1.7 |
| Test #4 | 35 | 9660 | 110.4 | 3857 | 159.4 | 1.6 |
| Titleist Professional | 58 | 7685 | 108.7 | 3546 | 161.6 | 3.2 |
| Titleist Tour Balata | 48 | 8989 | 109.9 | Not tested | Not tested | 4.8 |
| Titleist HP Tour | 58 | 7708 | 109.4 | Not tested | Not tested | 1.5 |
| Taylor Made InerGel Pro | 56 | 8140 | 109.4 | 3151 | 160.9 | 1.3 |
| Taylor Made InerGel Pro Distance | 61 | 7947 | 110.0 | 2961 | 161.7 | 1.3 |

Results

Each of the test balls demonstrated lower cover hardness and higher ball spin rate than any of the marketed balls tested. As discussed above, high spin rate is desirable because it allows for improved control of the ball when hit. Low ball cover hardness provides for improved ball feel when hit. The test balls also demonstrated ball speeds higher than or roughly equal to that of the marketed balls, despite the fact that low ball hardness generally leads to reduced ball speed. High ball speed is desirable because it leads greater flying distance of the ball when hit. Balls of the present invention, therefore, overcome design limitations previously known in the manufacture of golf balls, i.e., that softer ball covers generally provide reduced ball speeds. Balls of the present invention provide good spin rate and feel, as well as good distance performance.

Additionally, the test balls demonstrated shear resistance, and therefore durability, either comparable to or superior to that of a number of the marketed balls. In particular, test balls 1 and 2 demonstrated shear resistance comparable to that of the Titleist Professional and Tour Balata balls, even though the test balls had a far lower cover hardness. Typically, low cover hardness leads to poor shear resistance. Test balls 1 and 2, however, exhibited a combination of a soft cover and durability superior to the Professional and Tour Balata balls. Test balls 3 and 4, which incorporated the HG-252 material, exhibited even better shear resistance than test balls 1 and 2, while maintaining low cover hardness. Test balls 3 and 4 exhibited shear resistance comparable to the Titleist HP Tour and Taylor Made InerGet Pro and ProDistance balls, even though cover hardnesses for test balls 3 and 4 were far lower. Overall, the test results for shear resistance indicate that balls of the present invention provide for a combination of low cover hardness and high shear resistance in comparison to balls currently available. This combination allows balls to be made that are exhibit good feel and also are durable.

Generally, it is difficult to produce golf balls having high spin rate, long distance when hit, good feel, and good durability. The test balls incorporating nanocomposite material exhibited all of these. The performance of the test balls demonstrates the superiority of the nanocomposite blends in maximizing ball properties that, using conventional methods, tend to relate inversely to each other.

Although the invention has been disclosed in detail with reference only to the preferred embodiments, those skilled in the art will appreciate that additional compositions for ball covers comprising nanocomposite and/or nanofiller materials can be made without departing from the scope of the invention.

We claim:

1. A golf ball comprising a core, wherein the core comprises nanocomposite material, wherein the nanocomposite material comprises a polymer having a structure in which particles of inorganic material are reacted and substantially evenly dispersed, and wherein each particle has a largest dimension that is about one micron or less and that is at least an order of magnitude greater than such particle's smallest dimension.

2. A golf ball as defined in claim 1, wherein the polymer is selected from the group consisting of polyamide, ionomer, polycarbonate, polyurethane, polystyrene, fluoropolymer, polyamide elastomer, polyester elastomer, polyester, polyolefin, thermoplastic elastomer, thermoplastic vulcanizate, and epoxy resin, and mixtures thereof.

3. A golf ball as defined in claim 1, wherein the particles of inorganic material consist essentially of clay.

4. A golf ball as defined in claim 3, wherein the clay is selected from the group consisting of hydrotalcite, montmorillonite, micafluoride, and octosilicate.

5. A golf ball as defined in claim 1, wherein the core comprises about 1 to about 50 percent by weight nanocomposite material.

6. A golf ball as defined in claim 5, wherein the core comprises about 1 to about 40 percent by weight nanocomposite material.

7. A golf ball as defined in claim 6, wherein the core comprises about 5 to about 30 percent by weight nanocomposite material.

8. A golf ball having a core as defined in claim 1, wherein the golf ball further comprises, a layer of rubber thread encasing the core, and a cover layer encasing the layer of rubber thread.

9. A golf ball having a core or a layer surrounding the core comprising from about 10 to about 20 percent by weight of nanocomposite material, wherein the nanocomposite material comprises a polyamide in the structure of which phillosilicate particles are substantially evenly dispersed, wherein each phillosilicate particle has a largest dimension that is about one micron or less and that is at least an order of magnitude greater than such phillosilicate particle's smallest dimension;

wherein the golf ball further comprises a block copolymer.

10. A golf ball as defined in claim 9, wherein the block copolymer is a polyether amide block copolymer.

11. A golf ball as defined in claim 9, wherein the block copolymer comprises:

a first polymer block comprising an aromatic vinyl compound;

a second polymer block comprising a conjugated diene compound; and a hydroxyl group located at a terminal block copolymer.

12. A golf ball as defined in claim 9, further comprising the hydrogenation product of a block copolymer, comprising:

a first polymer block comprising au aromatic vinyl compound;

a second polymer block comprising a conjugated diene compound; and a hydroxyl group located at a terminal block copolymer.

* * * * *